US007930909B2

(12) United States Patent
Lee

(10) Patent No.: US 7,930,909 B2
(45) Date of Patent: Apr. 26, 2011

(54) STEAM GENERATOR AND WASHING/DRYING MACHINE HAVING THE SAME

(75) Inventor: Kyu-Won Lee, Gycongsanguam-Do (KR)

(73) Assignee: LG Electronics Inc., Seoul (KR)

( * ) Notice: Subject to any disclaimer, the term of this patent is extended or adjusted under 35 U.S.C. 154(b) by 289 days.

(21) Appl. No.: 12/230,630

(22) Filed: Sep. 2, 2008

(65) Prior Publication Data

US 2009/0064731 A1 Mar. 12, 2009

(30) Foreign Application Priority Data

Sep. 3, 2007 (KR) ..... 10-2007-0089175

(51) Int. Cl.
*D06F 39/04* (2006.01)

(52) U.S. Cl. ..... 68/17 R; 68/207

(58) Field of Classification Search ..... 68/15, 207
See application file for complete search history.

(56) References Cited

U.S. PATENT DOCUMENTS 2,431,246 A * 11/1947 Hallanan ..... 68/207
2,664,094 A * 12/1953 Harris ..... 134/58 DL
3,402,576 A * 9/1968 Krupsky ..... 68/4
4,279,384 A * 7/1981 Yamamoto ..... 239/67
4,948,947 A * 8/1990 Kang ..... 392/386
2006/0277690 A1 * 12/2006 Pyo et al. ..... 8/149.2

FOREIGN PATENT DOCUMENTS

| | | | |
|---|---|---|---|
| EP | 0 091 379 | * | 4/1983 |
| EP | 0 816 550 | * | 1/1998 |
| FR | 2 596 429 | * | 3/1987 |
| JP | 61-128995 | * | 6/1986 |
| JP | 07-235368 | * | 9/1995 |
| JP | 2003-311084 | * | 11/2003 |

* cited by examiner

*Primary Examiner* — Frankie L Stinson
(74) *Attorney, Agent, or Firm* — McKenna Long & Aldridge LLP

(57) ABSTRACT

Disclosed are the steam generator and the washing/drying machine having the same, the steam generator including: a case having an opening at one side thereof, a heating unit formed to penetrate the opening, and a fixing assembly mounted at the opening so as to seal the opening and supporting the heating unit, wherein the fixing assembly includes a sealing member for sealing the opening, and the opening includes a leakage prevention portion for preventing a gap formation between the opening and the sealing member when the sealing member is deformed, thereby preventing a leakage between the opening of the case and the sealing member even though the case or the sealing member is thermally deformed.

3 Claims, 4 Drawing Sheets

【Fig. 1】
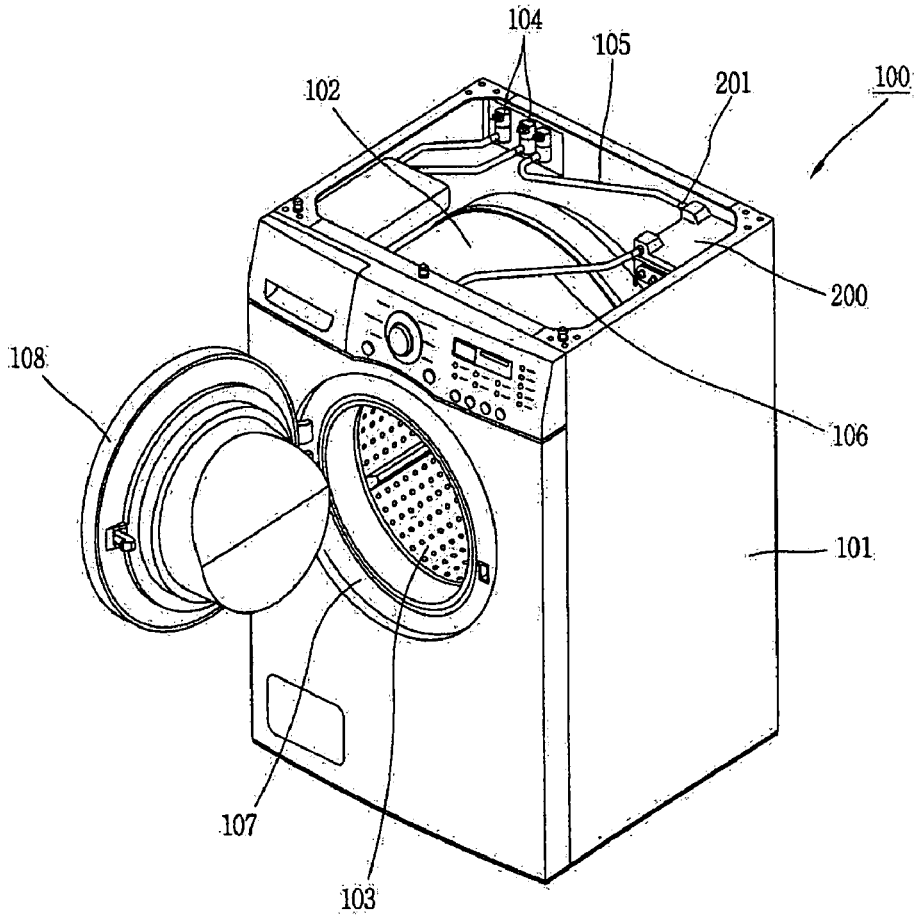
【Fig. 2】
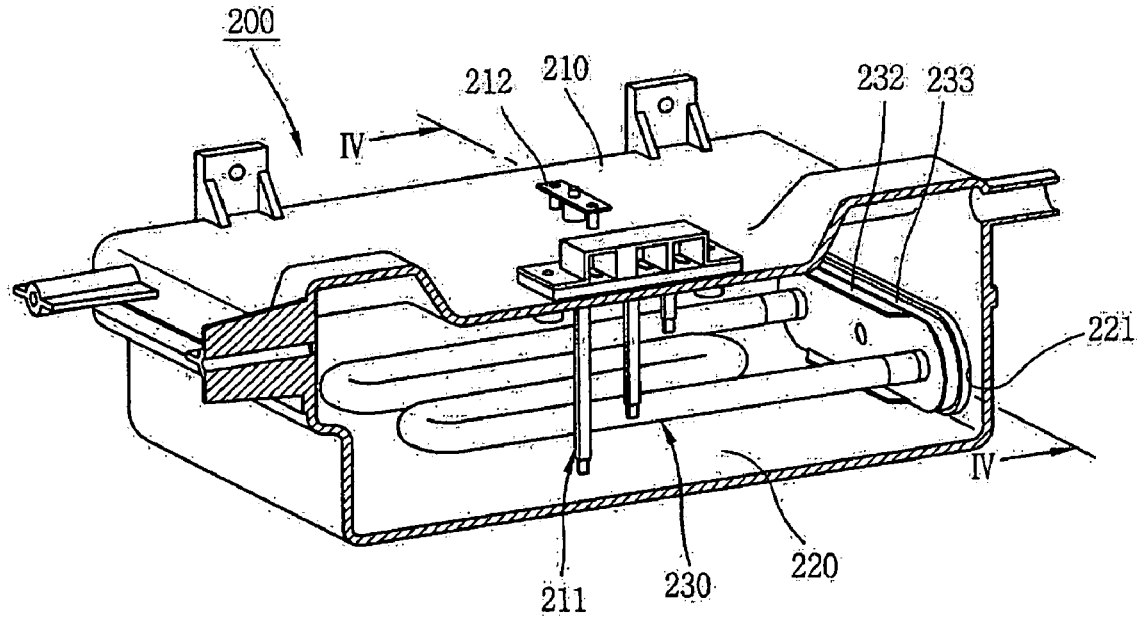

【Fig. 3】
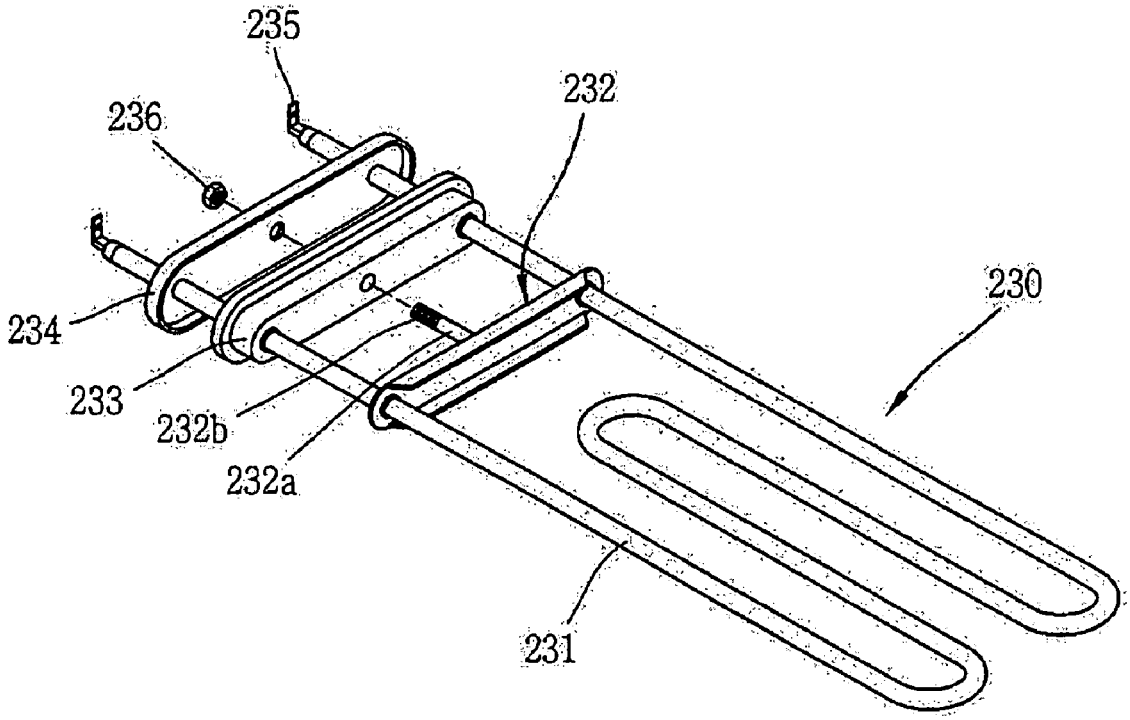
【Fig. 4】
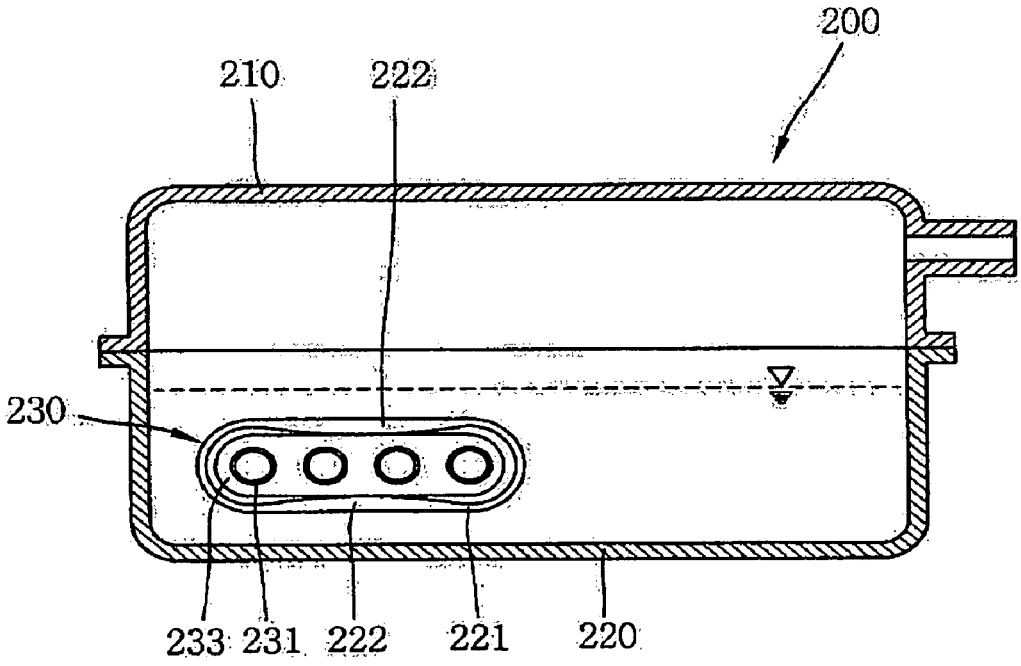

【Fig. 5】
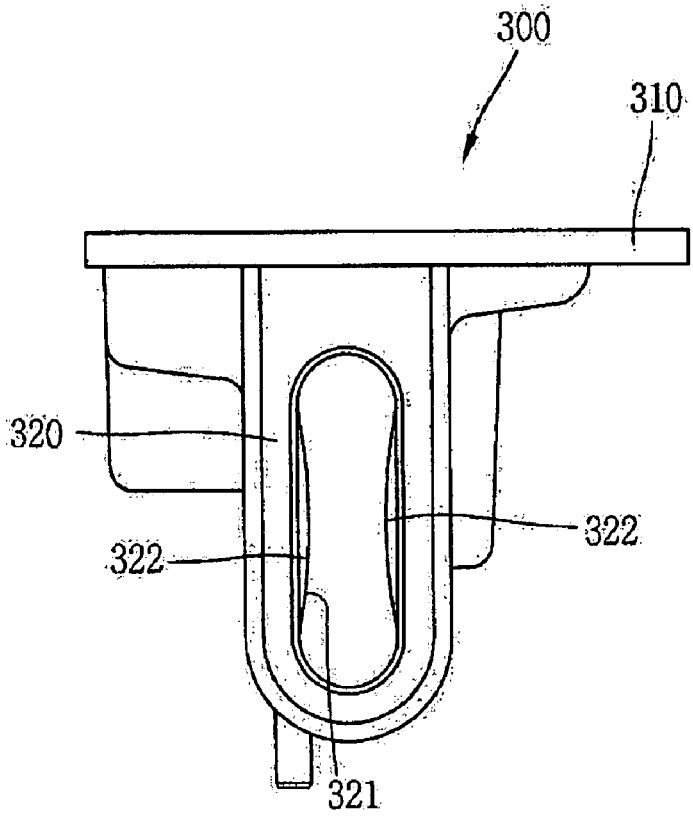
【Fig. 6】
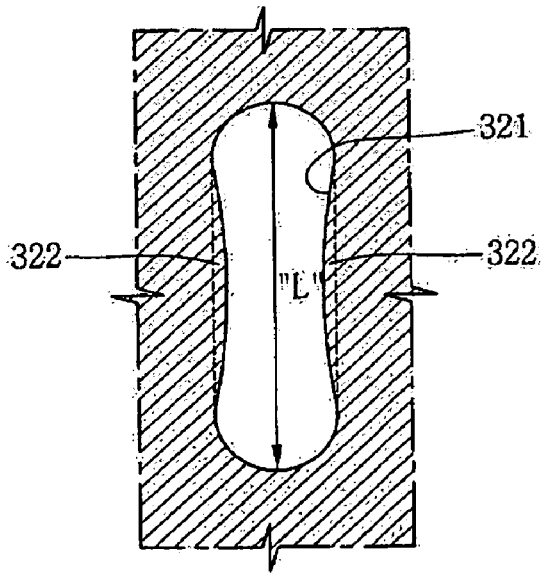

【Fig. 7】
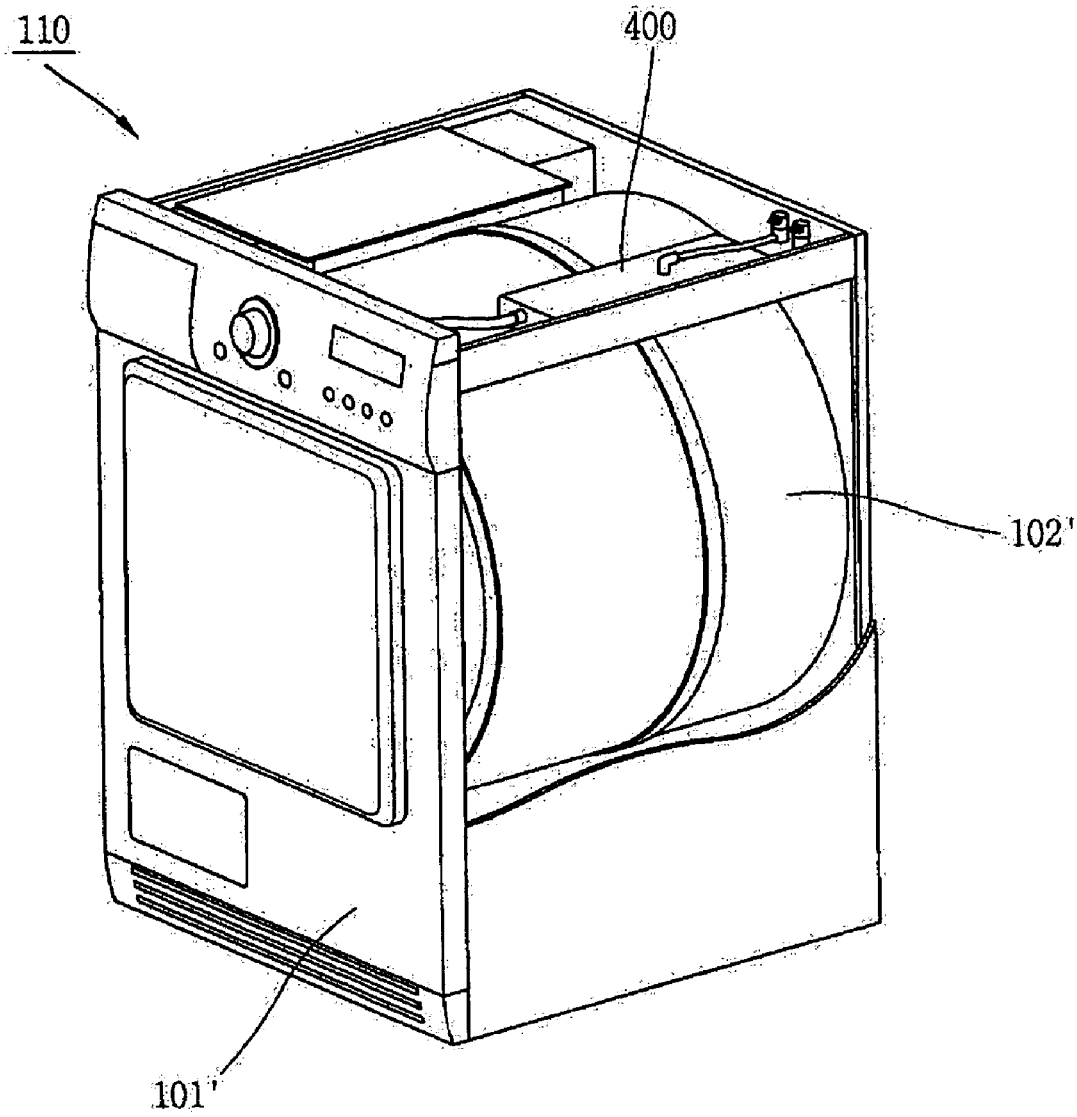

STEAM GENERATOR AND WASHING/DRYING MACHINE HAVING THE SAME

RELATED APPLICATION

The present disclosure relates to subject matter contained in priority Korean Application No. 10-2007-0089175, filed on Sep. 3, 2007, which is herein expressly incorporated by reference in its entirety.

BACKGROUND OF THE INVENTION

1. Field of the Invention

The present invention relates to a steam generator, and more particularly, to a steam generator having a leakage prevention portion at an opening of a case to which a heater is mounted so as to prevent a leakage between the heater and the case of a steam generator, and a washing/drying machine having the same.

2. Background of the Invention

In general, a washing machine is divided into a pulsator-type washing machine which uses a water current generated when a plate-shaped pulsator is rotated, and a drum-type washing machine which uses a head and friction of washing water and laundry generated within a laid-down drum when the drum is rotated.

The drum type washing machine has an increasing demand with more advantages when compared to the pulsator-type washing machine, for instance, requiring less amounts of water and a detergent, causing less damage to the clothes, preventing entanglement of laundry, and the like. Technical description of such conventional drum type washing machine is disclosed in Korean Patent Laid Open Publication No. 10-2007-0041222 filed by the present applicant.

The conventional drum type washing machine may include a cabinet forming an external appearance, a cylindrical tub horizontally supported inside the cabinet for containing washing water therein, a drum having a through-hole to introduce the washing water and steam thereto and rotatably mounted inside the tub, a driving motor for driving the drum, and at least one or more steam generators for supplying steam to inside the drum.

The steam generator may include a case for forming an external appearance, a water level sensor disposed inside the case for sensing a supplied water level, a heater for heating the supplied water, and a temperature sensor for sensing heated water temperature. A steam supply pipe serving as a passage to guide and inject the steam generated in the steam generator to inside the drum is formed at one side of the steam generator.

However, the steam generator of the conventional drum type washing machine has the following problems.

As the steam generator is used, a temperature of the supplied water within the case increases, thereby causing a thermal deformation to a heater mounting portion of the steam generator case, thus to cause a leakage of water inside the case.

In particular, a central portion of the opening formed at the steam generator case so as to mount the heater is thermally deformed, or a central portion of a sealing member mounted at the heater for tightly adhering (sealing) the steam generator case and the heater contact portion is concaved, thereby causing a problem of water leakage.

SUMMARY OF THE INVENTION

Therefore, an object of the present invention is to provide a steam generator which can prevent a leakage between a case and a sealing member, even though the case or the sealing member is thermally deformed, by forming an opening of a steam generator case for mounting the heater to be smaller than the sealing member of the heater, and a washing/drying machine having the same.

Another object of the present invention is to provide a steam generator having a leakage prevention portion at an, opening of the case for mounting the heater so as to prevent a leakage between the heater and a steam generator case, and a washing/drying machine having the same.

To achieve these and other advantages and in accordance with the purpose of the present invention, as embodied and broadly described herein, there is provided a steam generator, including: a case having an opening at one side thereof, a heating unit formed to penetrate the opening, and a fixing assembly mounted at the opening so as to seal the opening and supporting the heating unit. Here, the opening may be formed to have a smaller size than a sealing member of the fixing assembly for sealing the opening.

There is provided a steam generator, including: a case having an opening at one side thereof, a heating unit formed to penetrate the opening, and a fixing assembly mounted at the opening so as to seal the opening and supporting the heating unit. Here, the fixing assembly includes a sealing member for tightly adhering (sealing) the opening, and the opening includes a leakage prevention portion for preventing a gap formation between the opening and the sealing member when the sealing member is deformed.

With such configuration, the water leakage between the sealing member of the heating unit and the case can be prevented even though the heating unit/the heater and the case of the steam generator are thermally deformed.

That is, a degree of thermal deformation of the heater/heating unit and the case may be expected, so that the opening of the case may be formed to be smaller or the sealing member of the heating unit may be formed to be larger according to the expected degree of thermal deformation.

Here, the leakage prevention portion is formed at a central portion of the opening in the lengthwise direction. This is to minimize the leakage in the central portion of the sealing member where the thermal deformation is greatly occurred.

In addition, the leakage prevention portion may be formed to protrude from edges of the opening in the lengthwise direction toward a center thereof. Here, it is effective that a degree of protrusion of the leakage prevention portion is the greatest in the central portion of the opening in the lengthwise direction, and the smallest in both ends thereof in the lengthwise direction. This is because the central portion of the sealing member is the most concave due to the thermal deformation.

Meanwhile, the leakage prevention portion may be formed such that an overall size of the opening is formed to be smaller than that of the sealing member. That is, the central portion of the opening may be formed to be smaller or to protrude. In addition, the entire opening may be formed smaller than the entire sealing member, thereby preventing the water or steam leakage in the opening or the central portion as well as other portion of the sealing member.

To achieve these and other advantages and in accordance with the purpose of the present invention, as embodied and broadly described herein, there is provided a washing/drying machine, including: a cabinet having a receiving space therein, a tub mounted inside the cabinet, a spin basket rotatably mounted inside the tub, and the above-described steam generator mounted between the cabinet and the tub for generating steam. Here, preferably, the washing/drying machine is implemented as a drum type washing machine or a drum type washing/drying machine.

There is further provided a washing/drying machine, including: a cabinet having a receiving space therein, a drying drum mounted inside the cabinet, and a steam generator mounted between the cabinet and the drying drum for generating steam. Here, the washing/drying machine is a drum type drying machine.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 1 is a perspective view showing a drum type washing machine having a steam generator according to one embodiment of the present invention;

FIG. 2 is a cross-sectional perspective view showing the steam generator in FIG. 1;

FIG. 3 is an exploded perspective view showing a heater in FIG. 2;

FIG. 4 is a cross-sectional view taken along line 'IV-IV' in FIG. 2;

FIG. 5 is a view showing another exemplary steam generator in FIG. 2;

FIG. 6 is a view showing an opening of the steam generator case in FIG. 5; and FIG. 7 is a perspective view showing a drum type drying machine having the steam generator according to one embodiment of the present invention.

DETAILED DESCRIPTION OF THE INVENTION

Description will now be given in detail of the preferred embodiments of the present invention, examples of which are illustrated in the accompanying drawings. The following description represents many aspects that can be claimed, and constitutes a part of detailed description about the present invention.

Detailed explanation about well-known functions or configurations will be omitted so as to implement the present invention more explicitly.

Hereinafter, for the sake of convenience, a drum type washing machine as an example of the washing/drying machine will be described in detail.

FIG. 1 is a perspective view showing a drum type washing machine having a steam generator according to one embodiment of the present invention.

Referring to FIG. 1, the drum type washing machine 100 according to one embodiment of the present invention may include a cabinet 101 forming an external appearance, a cylindrical tub 102 horizontally supported inside the cabinet 101 for containing washing water therein, a drum 103 rotatably mounted inside the tub 102, a driving motor (not shown) for driving the drum 103, and at least one or more steam generators 200 installed at a space between the cabinet 101 and the tub 102 so as to supply a steam to inside the drum 103.

Preferably, the steam generator 200 is attached to the cabinet 101 for facilitating a mounting/dismounting process and maintenance. A water supply valve 104 connected to an external water pipe, etc. so as to supply washing water to inside the tub 102 is provided at one side of the drum type washing machine 100.

A water supply inlet 201 connected to the water supply valve 104 of the drum type washing machine 100 via a water supply pipe 105 is formed at one side of the steam generator 200. A steam discharge outlet (not shown) connected to a steam supply pipe 106 so as to supply the generated steam to inside the drum 103 is formed at another side of the steam generator 200.

Preferably, an end of the steam supply pipe 106 is formed to have a nozzle shape such that steam may be smoothly injected toward an inner space of the drum 103, and the end of the steam supply pipe 106 for discharging the steam is installed to be exposed toward inside the drum 103.

Accordingly, it is preferable that the steam generator 200 is configured such that channels each connecting the water supply valve 104 and the steam supply pipe 106 are formed to have a relatively short length, and that the steam generator 200 is mounted above the tub 102 to facilitate repair and maintenance.

Description of the detailed construction of the steam generator 200 will be given with reference to the drawings. FIG. 2 is a cross-sectional perspective view showing the steam generator in FIG. 1, FIG. 3 is an exploded perspective view showing a heater in FIG. 2, and FIG. 4 is a cross-sectional view taken along line 'IV-IV' in FIG. 2.

Referring to FIG. 2, the steam generator 200 may include a case 210, 220 for forming an external appearance, a water level sensor 211 disposed inside the case 210, 220 for sensing a supplied water level, a heating unit 231 for heating the supplied water, and a temperature sensor 212 for sensing heated water temperature. More specifically, the steam generator 200 is configured to have the case 210, 220 having an opening at one side thereof, the heating unit 231 formed to penetrate the opening 221, and a fixing assembly for tightly sealing the opening 221 so as to mount the heating unit 231 to the opening 221 as well as supporting the heating unit 231. Here, the opening 221 may be formed to have a smaller size than a sealing member 233 of the fixing assembly for sealing the opening 221.

In addition, the case 210, 220 may be integrally formed, however, it is preferable to have an upper case 210 and a lower case 220 formed to have a corresponding shape to the upper case 210 in order to mount the heating unit 231, etc. inside the case.

Preferably, the opening 221 is formed at one side of the lower case 220 among the two cases 210, 220, but such a described configuration is not meant to be limiting. The heating unit 231 may be mounted at the upper case 210, and in this case, it would be effective to form the opening at the upper case 210.

Here, detailed configuration of the heater 230 including the heating unit 231, etc. is illustrated in FIG. 3.

Referring to FIG. 3, the heater 230 may include the heating unit 231 having a heater thermal fuse (not shown) built therein, an outer bracket 234 for fixing the heating unit 231 to the case 210, 220, the sealing member 233 mounted to be closely adhered at one side of the outer bracket 234, and an inner bracket 232 closely adhered at the sealing member 233 to face the outer bracket 234 and coupled to the outer bracket 234.

Here, the fixing assembly is configured to have the inner bracket 232, the sealing member 233, and the outer bracket 234. In addition, a heating unit fixing means may be further provided such that the coupling state between the heating unit 231 and the inner bracket 232 can be prevented from being loose.

Meanwhile, a coupling rod 232*a* protruding toward the sealing member with a certain length is attached to the inner bracket 232, and a screw thread 232*b* is formed at an end of the coupling rod 232*a*.

Here, the sealing member 233 and the outer bracket 234 are penetrated by the coupling rod 232*a*, and then a nut 236 is coupled to the screw thread 232*b* of the coupling rod 232*a*, whereby the heating unit 231, the inner bracket 232, the sealing member 233 and the outer bracket 234 are all coupled together, thus to form the heater 230.

Here, the heating unit 231 is formed to have an approximately hollow pipe shape, and a terminal 235 for supplying electricity is attached to one end thereof.

FIG. 4 illustrates a state that the heater 230 is mounted within the case 210, 220 of the steam generator 200.

Referring to FIG. 4, the heater 230 including the heating unit 231, and the like is configured to heat water supplied into the case 210, 220, thereby requiring to be sunk in the water. Most preferably, the heater 230 is installed at a lower portion of the lower case 220 such that the heater 230 remains to be sunk in the water even though an amount of water contained in the case 210, 220 is reduced due to the evaporation.

Meanwhile, the opening 221 to which the fixing assembly is mounted is formed at the lower portion of the lower case 220. Here, it is preferable that the shape of the opening 221 is formed to have the same as or similar to that of the fixing assembly of the heater 230, and more specifically, of the sealing member 233.

The coupling relationship between the opening 221 of the lower case 220 and the fixing assembly of the heater 230 is as follows: the sealing member 233 is directly fitted into the opening 221, and the inner bracket 232 and the outer bracket 234 contact the respective inner and outer surfaces of the opening 221.

Meanwhile, high-temperature water or steam existing inside the case 210, 220 directly contacts the case 210, 220 or the sealing member 233, thereby having a high possibility of thermally deforming the case 210, 220 or the sealing member 233 of the heater 230.

The opening 221 is formed to be smaller than the sealing member 233 such that water leakage between the sealing member 233 and the opening 221 of the lower case 220 may be prevented even though the sealing member 233 or the lower case 220 is thermally deformed. That is, a degree of thermal deformation of the sealing member 233 and the lower case 220 may be expected through an experiment or the like, so that the opening 221 may be formed to be smaller or the sealing member 233 to be larger according to the expected degree of the thermal deformation. Accordingly, the water or steam leakage in a portion where the opening 221 and the sealing member 233 are coupled can be prevented.

When compared to the conventional steam generator, the overall size of the opening 221 may be formed smaller than that of the sealing member 233, thereby capable of preventing the water or steam leakage in the opening 221 or the central portion of the sealing member 233 as well as other portion thereof.

For instance, if the width of the opening 221 (i.e., a shorter inside diameter) is set to be 18 mm and the width of the sealing member 233 is set to be 19 mm, the sealing member 233 is shrink-fitted into the opening 221 by 1 mm, causing the deformation such as a concaved sealing member 233. Therefore, at least a gap of 1 mm can be prevented from being formed between the opening 221 and the sealing member 233.

Meanwhile, in order to prevent the water leakage due to the thermal deformation, a leakage prevention portion may be further disposed at the opening 221, in addition to controlling the size of the opening 221 or the sealing member 233.

Referring to FIG. 4, a central portion of the opening 221 in a lengthwise direction is formed to protrude, and such protruding portion functions as a leakage prevention portion 222.

Most preferably, the leakage prevention portion 222 is formed at the approximate central portion of the opening 221 in the lengthwise direction. This is because a central portion of the sealing member 233 in the lengthwise direction is most concave due to the thermal deformation. That is, the width of the central portion of the opening 221 is formed to be smaller than that of other portion thereof.

As shown in FIG. 4, the opening 221 or the sealing member 233 is formed to have an approximate track shape in a stadium, thereby being divided into a lengthwise direction having a longer diameter and a width direction having a shorter diameter. However, such described shape of the opening 221 or the sealing member 233 is not meant to be limiting.

With such configuration, even though the central portion of the sealing member 233 is concaved due to the thermal deformation, the leakage prevention portion 222 of the opening 221 enables to prevent the leakage between the sealing member 233 and the opening 221, thereby reducing an amount of water being leaked between the sealing member 233 and the lower case 220.

By expecting the concaved degree (depth) of the central portion of the sealing member 233, the leakage prevention portion 222 may be formed to gradually protrude from each end of the opening 221 toward the central portion thereof as much as the sealing member 233 is to be concave, thus to maximize the effect of the leakage prevention portion 222.

Here, the protruding degree of the leakage prevention portion 222 is the smallest at both ends of the opening 221 in the lengthwise direction, and the greatest at the central portion of the opening 221 in the lengthwise direction. This is because the concaved depth of the sealing member 233 due to the thermal deformation is the greatest in the central portion of the sealing member 233 in the lengthwise direction.

For instance, the width of the both ends of the opening 221 in the lengthwise direction is set to be 18 mm and the width of the leakage prevention portion 222 at the central portion thereof is set to be 17.8 mm. Since the leakage prevention portion 222 protrudes by 0.2 mm, even though the central portion of the sealing member 233 is concaved by approximately 0.2 mm, at least a gap less than 0.2 mm can be prevented from being formed between the opening 221 and the sealing member 233.

Meanwhile, the case 210, 220 of the steam generator 200 as shown in FIG. 4 is formed to have an approximately rectangular parallelepiped shape. Since the heater 230 is laid down for mounting, the opening 221 is also laid down. Such opening 221 is sunk in the water for most of the time, thereby requiring maintenance for the water leakage of the entire opening 221. However, if the heater or the opening is mounted in an upright position, a portion requiring the maintenance for the water leakage would be different.

FIG. 5 is a view showing another exemplary steam generator in FIG. 2, and FIG. 6 is a view showing an opening of the steam generator case in FIG. 5.

Referring to FIGS. 5 and 6, a case 310, 320 of a steam generator 300 includes an opening 321 disposed in an upright position in consideration of a limited space to mount the steam generator 300. A leakage prevention portion 322 protrudes from a central portion of the opening 321 in a lengthwise direction.

It should be noted that, when considering the shape of the case 310, 320 or the opening 321, the opening 321 is not entirely sunk in the water, and a lower portion of the opening 321 would be sunk in the water relatively for a long period of time.

Accordingly, the maintenance for the water leakage should be focused on the lower portion of the opening 321 disposed in the upright position. For this, it is preferable that the leakage prevention portion 322 is formed to extend to a lower portion of the opening 321. In addition, the opening 321 may have the same length as that in the previous example.

The steam generator 200, 300 may be applied to the drum type washing machine 100 as well as a drum type washing/drying machine, and further to a drying machine as shown in FIG. 7.

FIG. 7 is a perspective view showing a drum type drying machine having the steam generator according to one embodiment of the present invention.

Referring to FIG. 7, a drying machine 110 may include a cabinet 101' having a receiving space therein, a drying drum 102' disposed inside the cabinet 101', and a steam generator 400 disposed between the cabinet 101' and the drying drum 102' for generating steam.

Here, the steam generator 400 has the same configuration as that in FIGS. 4 and 5, and detailed explanations therefor are omitted.

As described above, the water leakage between the case and the sealing member can be prevented by changing the shape of the opening of the steam generator case or by forming the leakage prevention portion, even though the central portion of the sealing member of the heater is greatly concave due to the thermal deformation.

In addition, the leakage prevention portion is able to prevent the water as well as steam leakage.

The steam generator according to the present invention may also be applied to a variety of electronic appliances, such as the drum type washing machine, the drum type washing/drying machine, and the drying machine as well as an integrated washing system, a refresher, a dishwasher, or the like.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A steam generator, comprising:

a case having an opening at one side thereof;

a heating unit formed to penetrate the opening; and a fixing assembly for sealing the opening so as to mount the heating unit to the opening and supporting the heating unit, wherein the fixing assembly includes a sealing member for sealing the opening, and the opening is formed to have to have a smaller size than the sealing member, wherein the opening is provided with a leakage prevention portion, which protrudes from the central portion of the opening in the lengthwise direction toward a center thereof, and a degree of protrusion of the leakage prevention portion is the greatest in the central portion of the opening in the lengthwise direction and the smallest in both ends thereof in the lengthwise direction.

2. The steam generator of claim 1, wherein the fixing assembly further comprises an outer bracket and an inner bracket.

3. A drum type washing machine installed between a cabinet and a drum and having a steam generator for generating a steam, the steam generator comprising:

a case having an opening at one side thereof;

a heating unit formed to penetrate the opening; and a sealing member for sealing the opening so as to mount the heating unit, wherein the sealing member is formed to have a larger size than the opening, wherein the opening is provided with a leakage prevention portion, which protrudes from the central portion of the opening in the lengthwise direction toward a center thereof, and a degree of protrusion of the leakage prevention portion is the greatest in the central portion of the opening in the lengthwise direction and the smallest in both ends thereof in the lengthwise direction.

* * * * *